United States Patent [19]

Gottlieb

[11] Patent Number: 4,793,550

[45] Date of Patent: Dec. 27, 1988

[54] REINFORCED CARTON

[75] Inventor: Norman J. Gottlieb, Thornhill, Canada

[73] Assignee: Container Corporation of Canada, Richmond Hill, Canada

[21] Appl. No.: 115,390

[22] Filed: Nov. 2, 1987

[51] Int. Cl.[4] ..... B65D 5/02; B65D 5/54

[52] U.S. Cl. ..... 229/199; 206/616

[58] Field of Search ..... 229/199; 206/616, 606

[56] References Cited

U.S. PATENT DOCUMENTS 1,527,021 2/1925 Wandel ..... 229/199

4,160,519 7/1979 Gorham ..... 229/199

4,702,408 10/1987 Powlenko ..... 229/199

*Primary Examiner*—Willis Little

*Attorney, Agent, or Firm*—Fetherstonhaugh & Co.

[57] ABSTRACT

A carton having a binding strap secured to its perimeter wall so that it is retained in close proximity to the perimeter wall. The strap has a sufficient length to extend about the perimeter wall and to provide first and second end portions at first and second margin portions of the wall. The first and second end portions are connectable such that the strap may form a reinforcing band which extends about the perimeter of the load storage compartment.

16 Claims, 3 Drawing Sheets

REINFORCED CARTON

Figure 1:
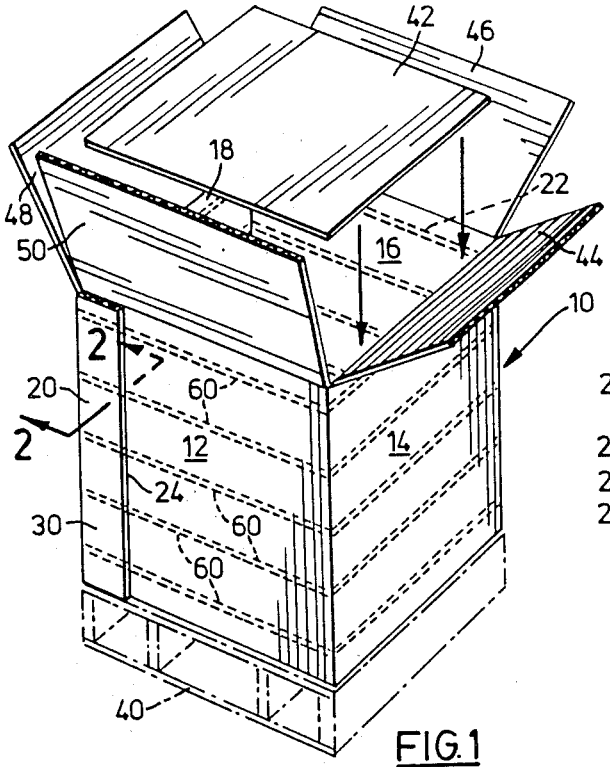

This invention relates to reinforced cartons. In particular this invention relates to cartons which are reinforced by binding straps.

PRIOR ART

Binding straps have long been used to form a reinforcing band extending around the walls of a paperboard carton. In one application wherein the paperboard carton is designed as a shipper carton for meat products, it is common to make the carton from corrugated paperboard and to use a heavy weight of paperboard in order to achieve the required structural strength even when reinforced with binding straps. In many applications, it is common to load a paperboard carton with goods and then to apply a binding strap around a perimeter of the carton and to connect the ends of the strap to one another to form a continuous band. It is very difficult to perform this type of banding operation before the carton is loaded because the carton does not offer the support required in order to draw the band tight before the ends are connected. Unfortunately, however, in many applications the load which is to be shipped in the carton will deform the walls of the carton if the walls are not reinforced before the carton is loaded.

When reinforcing cartons of the type which are to be used for the bulk shipment of meat products and the like, it is common to form apertures in the wall of the carton, one on either side of each corner formed between adjoining side walls and to thread a binding strap through these apertures so that portions of the strap which bridge the corner are located within the container space and the remainder of the strap is located on the outside of the carton. The ends of these straps can then be connected so that the carton can be shipped in a knock-down configuration with the reinforcing straps operably retained on the walls. This structure is, however, costly and time-consuming to assemble because it requires the operator to thread the binding strap through the apertures after the carton has been manufactured.

Furthermore, because the binding strap bridges the corners of the carton, it does not offer support for the corner and consequently, the carton tends to assume a generally circular cross-sectional configuration rather than a conventional rectangular configuration.

In addition, because the bindings straps extend inside the load storage compartment of the carton, they tend to form an obstruction which interferes with the simple loading and unloading of the carton.

SUMMARY OF INVENTION

It is an object of the present invention to provide a simple and inexpensive carton which has binding straps connected thereto, the ends of which can be connected in order to form a continuous, reinforcing band about the perimeter of the carton.

According to one aspect of the present invention, in a carton having a side wall which forms a perimeter wall of a load storage compartment and wherein the side wall has first and second side edges and first and second margin portions extending inwardly from said first and second side edges respectively, said first margin portion overlapping and being secured to said second margin portion to form a lap-joint to complete the perimeter wall, the improvement of a binding strap secured to said perimeter wall so that it is retained in close proximity to the perimeter wall, said strap having a sufficient length to extend about the perimeter wall and to provide first and second end portions at the first and second margin portions respectively which are connectable such that the strap may form a reinforcing band which extends about the perimeter of the load storage compartment.

Figure 1A:
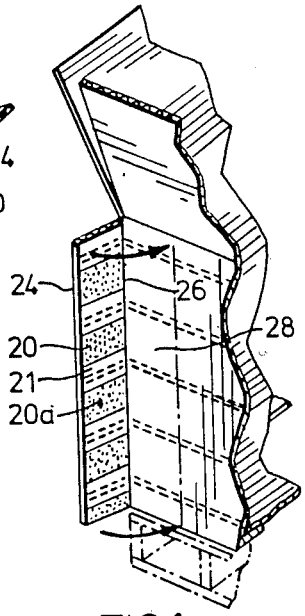
Figure 2:
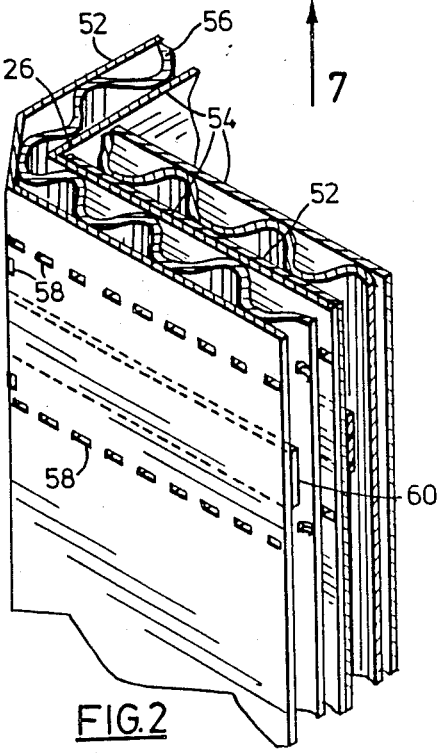
Figure 3:
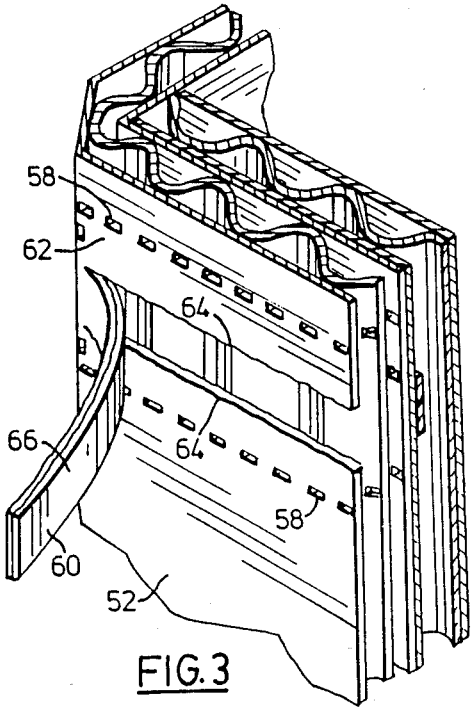
Figure 4:
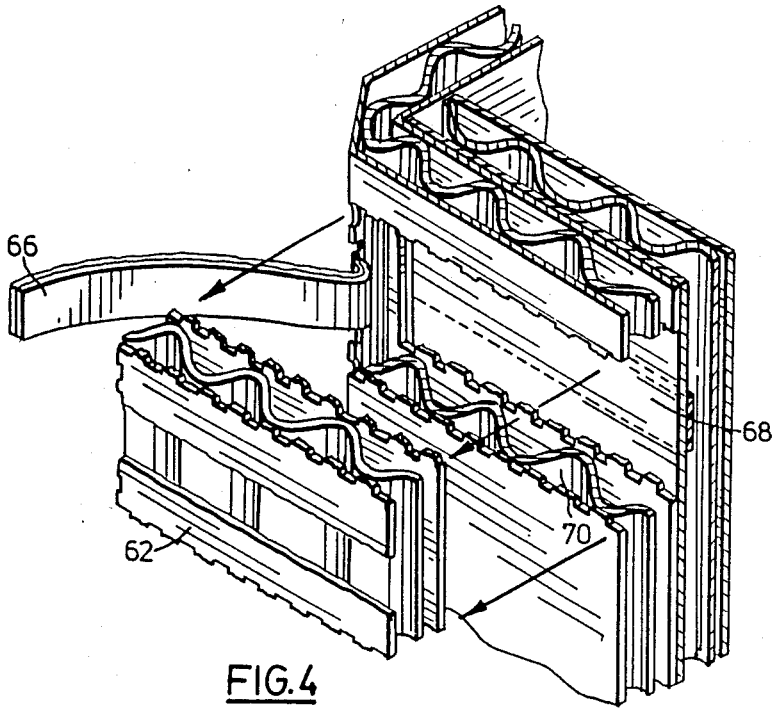
Figure 5:
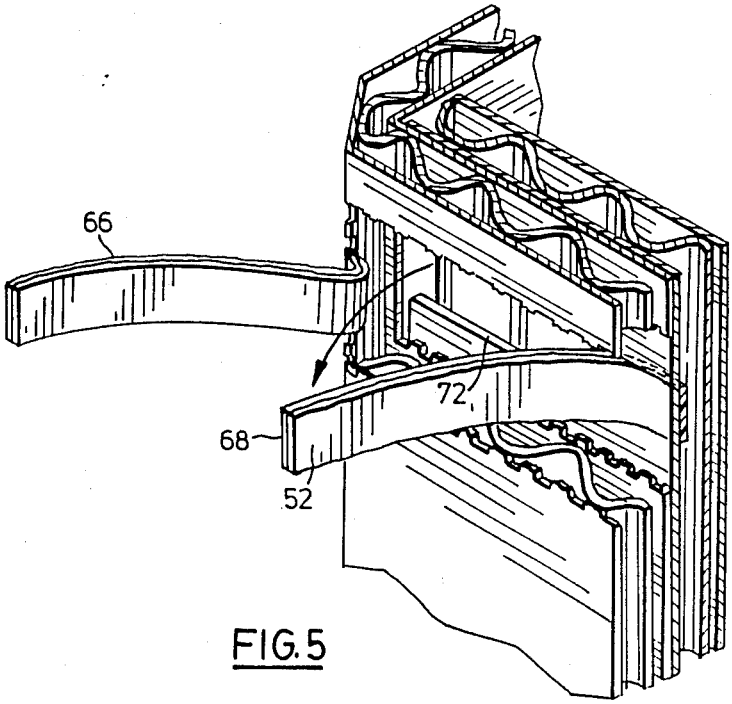
Figure 6:
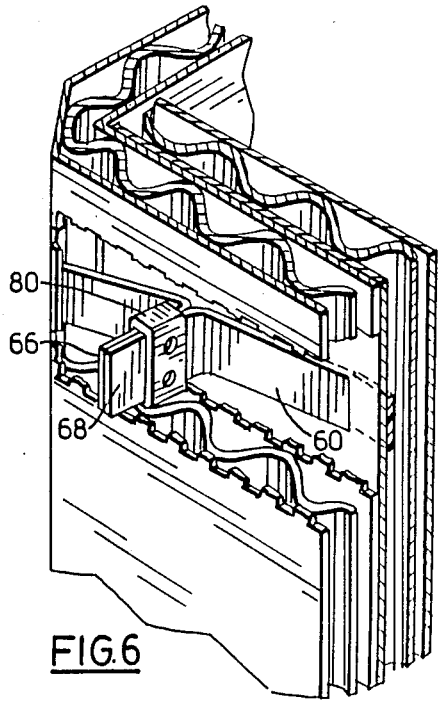
Figure 7:
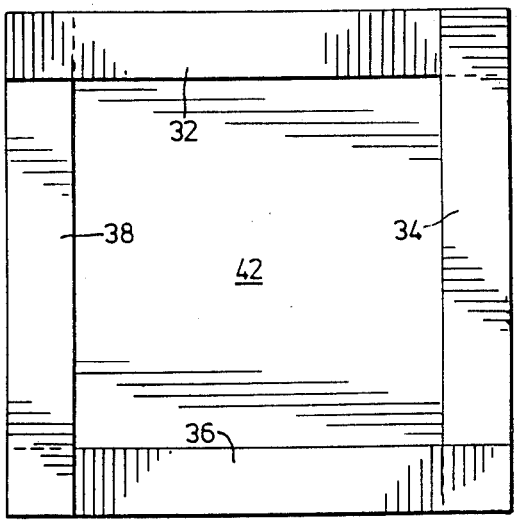

The invention will be more clearly understood after reference to the following detailed specification read in conjunction with the drawings wherein;

FIG. 1 is a pictorial view of a partially assembled carton constructed in accordance with an embodiment of the present invention, FIG. 1*a* is a pictorial view showing the manner in which the lap joint is formed between overlapping margins of the carton, FIG. 2 is a pictorial view illustrating a horizontal and vertical section taken through the lap joint of FIG. 1, FIG. 3 is a view similar to FIG. 2 showing the first end portion of the strap pealed back, FIG. 4 is a view similar to FIG. 3 showing the removable tab removed from the outer marginal edge to provide access to the underlying reinforcing strap, FIG. 5 is a view similar to FIG. 4 showing the second end portion of the reinforcing strap pealed back from its associated side wall, FIG. 6 is a view similar to FIG. 5 showing the exposed ends of the binding strap secured to one another by a connecting member, FIG. 7 is a plan view of the underside of the carton of FIG. 1.

With reference to FIG. 1 of the drawings, the reference numeral 10 refers generally to a carton constructed in accordance with an embodiment of the present invention. The carton is formed from corrugated paperboard and has side walls 12, 14, 16, 18 and 20 which cooperate with one another to form the side walls of a rectangular-shaped load storage compartment 22. The side wall 20 has a first side edge 24 and the side wall 12 has a second side edge 26. The side wall 20 forms a first margin which extends inwardly from the first side edge 24 which is arranged to overlap a second margin 28 which extends inwardly from the second side edge 26 as shown in FIG. 1*a* in order to form a lap joint which is generally identified by the reference numeral 30. As shown in FIG. 7 of the drawings, the cation 10 has bottom flaps 32, 34, 36 and 38 hingedly connected to the side walls 12, 14, 16 and 18 respectively. It will be noted that when these flaps are folded inwardly, they are not sufficiently long in order to extend to close the lower end of the carton. This type of carton is intended to be used on a support skid or platform 40 as shown in FIG. 1 and consequently, the bottom can be closed by providing a flat-inexpensive rectangular-shaped bottom wall insert 42 (FIG. 1) which extends in an overlying relationship with respect to the flaps 32, 34, 36 and 38, such that when the carton is loaded, the flaps 32, 34, 36 will be sandwiched between the bottom wall insert 42 and the skid 40. The bottom wall insert 42 can be made from an inexpensive material and consequently, a substantial reduction in the amount of expensive corrugated paperboard required to close the end of the carton is achieved.

The upper end of the carton is preferably formed with closure flaps 44, 46, 48 and 50 which are hingedly connected to the side walls 14, 16, 18 and 12 respectively, and can be folded inwardly to overlap one another to close the upper end of the load storage compartment 22.

For the purposes of reinforcing the perimeter of the carton, a plurality of binding straps 60 are provided, these straps 60 may be made from any suitable binding strap material such as a plastics material or a flexible metal strap.

When applied to a carton in which the walls are formed from corrugated paperboard consisting of an outer liner 52, an inner liner 54 and a corrugated medium 56, the straps 60 are sandwiched between the outer liner 52 and the corrugated medium 56. This structure is achieved in the manufacture of the corrugated paperboard by laying the reinforcing straps along the length of the inner face of the liner 52 before it is bonded to the corrugated medium. In this way, it is possible to accurately and inexpensively secure the binding straps to the walls of the corrugated paperboard.

In order to make the location of the reinforcing straps clearly visible, the outer face of the liner 52 may be formed with a coloured identification band extending along the path of the reinforcing strap. A carton blank may then be struck from the reinforced paperboard stock such that the reinforcing straps will extend across the side walls. Simultaneously with the blanking operation, perforations 58 are formed in the margin 30 and extend inwardly from the first edge 24 on either side of the strap 60 along which the side wall 20 may be torn to remove the tab 62 as shown in FIG. 4. An adhesive is applied to the inner face 20*a* of the panel 20 in the conventional manner. The portions 21 of the inner face 20 which will form the inner face of the tab 62 are preferably masked with a coating which will prevent adhesion between the tabs 62 and their underlying margin portion 28 to facilitate the removal of the tab 62 as will be described hereinafter.

After the adhesive has been applied and the areas 21 suitably masked, the margin 30 is located in a face-to-face overlying relationship with respect to the margin 28 to be adhesively secured thereto to complete the forming of the carton to an knock-down configuration.

At this time, the structural strength of the perimeter of the carton is dictated by the strength of the adhesive bond formed between the overlapping margins 30 and 28. To reinforce the carton, the ends of each of the straps 60 which are exposed at the side edge 24 of the margin 30 are manually engaged and are pealed away from the edge as shown in FIG. 3 thereby tearing the outer liner 52 along the tear lines 64. It will be understood that it is not necessary to form a clean cut along the tear line 64 and consequently, it is not necessary to weaken the outer liner 52 along the lines 64. The side edges of the strap 60 will function as cutting edges which will cut through the outer liner 52. Having thus pealed the first end portion 66 along the length of the tab 62, the tab 62 is then removed by grasping it and tearing it from the side wall 20 along the weakened tear lines 58. As previously indicated, the tab 62 is not adhesively secured to the underlying margin 28 and consequently, it can be removed with ease by tearing along the weakened tear lines. Having removed the tab as shown in FIG. 6 of the drawings, it is then possible to gain access to the second end portion 68. Again, it is merely necessary to reach through the window 70 which is formed by removing the tabs 62 in order to gain access to the second end 68. A hook-shaped tool may be used to initially pry the leading end of the second portion 68 of the strap through the window. The second end portion 68 of the strap can the be pealed back by tearing it through the outer layer 52 to form tear lines 72. When the first and second end portions 66 and 68 are exposed as shown in FIG. 5, it is then possible to connect these ends by means of a clinching collar 80 (FIG. 6) which may be crimped in order to firmly secure the ends 66 and 68 with respect to one another to form the strap 60 into an encircling band which has a tensile strength which is substantially greater than the strength of the lap joint. This procedure for connecting the ends of the straps can be carried out as a procedure in the manufacture of the cartons or as a preliminary step to the loading of the carton during the process of erecting the carton from the knock-down configuration to the open loading configuration.

From the foregoing, it will be apparent that the carton of the present invention incorporates a very strong binding strap which when its ends are connected, forms a very strong reinforcing band. The band will follow the contour of the side walls and will serve to assist in retaining the generally rectangular or square configuration of the carton. Furthermore, because the strap does not extend within the container space, it does not form an obstruction.

It will be apparent that because of the increased structural strength which can be achieved through the use of the reinforcing straps of the present invention, it is possible to reduce the structural strength of the corrugated paperboard from which a carton may be produced in order to provide a carton having a predetermined load carrying capacity. For this reason, although there may be a cost factor involved in the use of the straps, it is possible to recover this cost by reducing the weight or gage of the corrugated paperboard. In some instances, it has been found that in applications where it was customary to use a double layer corrugated paperboard, it is now possible to use a single layer corrugated paperboard.

Various modifications of the present invention will be apparent to those skilled in the art. For example, it is possible to connect the ends of certain types of straps by a heat sealing process in which case the clamping collar 80 would not be required. In addition, it is also possible to apply the straps 60 to the outer surface of the outer liner. In this application, the straps 60 may be adhesively secured to the outer surface of the liner. Furthermore, the invention is not limited to use in association with square-shaped cartons, it may be used in association with cartons having any number of sidewall panels including cylindrical drums. In a further modification, the binding straps may be in the form of cords or strings, the free ends of which may be tied together.

These and other modifications of the present invention will be apparent to those skilled in the art.

I claim:

1. In a carton having a side wall which forms a perimeter wall of a load storage compartment and wherein the side wall has first and second side edges and first and second margin portions extending inwardly from said first and second side edges respectively, said first margin portion overlapping and being secured to said second margin portion to form a lap-joint to complete the perimeter wall, the improvement of;

a binding strap secured to said perimeter wall so that is is retained in close proximity to the perimeter wall, said strap having a sufficient length to extend about the perimeter wall and to provide first and second end portions at the first and second margin portions respectively and which terminate at the first and second edges respectively, said first margin portion being formed with weakened tear lines which extend inwardly from the first edge on either side of the first end portion of the strap, said weakened tear lines terminating at or adjacent the second edge to form a removable tab which when removed forms a window in the first margin portion which provides access to the second end portion to permit the second end portion to be connected to the first end portions such that the strap may form a reinforcing band which extends about the perimeter of the load storage compartment.

2. A carton as claimed in claim 1, wherein said first and second ends of said strap are secured to one another to reinforce the perimeter wall.

3. A carton as claimed in claim 1, having a plurality of said binding straps secured to said perimeter wall at spaced intervals thereon.

4. A carton as claimed in claim 3, wherein the first and second ends of each strap are secured to one another to reinforce the perimeter wall.

5. A carton as claimed in claim 1, wherein the side walls are made from corrugated paperboard.

6. A carton as defined in claim 1, wherein the first and second ends of said strap are initially releasably secured to said first and second margins respectively.

7. A carton as claimed in claim 3, wherein the side walls are made from corrugated paperboard which comprises an inner liner, an outer liner and a corrugated medium which extends between the inner and outer liner and wherein the reinforcing strap is sandwiched between the corrugated medium and the outer liner such that the first and second end portions of the strap can be peeled back from the side edges of their respective margin portions by tearing them through their overlying outer liner.

8. A carton as claimed in claim 1, wherein said first and second ends of said strap are secured to one another by means of a connector member to reinforce the perimeter wall.

9. A carton comprising:

(a) a side wall which forms a perimeter wall of a load storage compartment, said side wall having first and second side edges and first and second margin portions extending inwardly from said first and second side edges respectively, said first margin portion overlapping and being secured to said second margin portion to form a lap-joint to complete the perimeter wall, (b) a binding strap secured to said perimeter wall so that it is retained in close proximity to the perimeter wall, said strap having a sufficient length to extend about the perimeter wall and to provide first and second end portions at the first and second margin portions respectively and which terminate at the first and second edges respectively, said first margin portion being formed with weakened tear lines which extend inwardly from the first edge on either side of the first end portion of the strap, said weakened tear lines terminating at or adjacent the underlying second edge to form a removable tab which when removed forms a window in the first margin portion which provides access to the second end portion, to free the second end portion for connection to the first end portion such that the strap may form a reinforcing band which extends about the perimeter of the load storage compartment.

10. A carton as claimed in claim 9, wherein said first and second ends of said strap are secured to one another to reinforce the perimeter wall.

11. A carton as claimed in claim 9, having a plurality of said binding straps secured to said perimeter wall at spaced intervals thereon.

12. A carton as claimed in claim 11, wherein the first and second ends of each strap are secured to one another to reinforce the perimeter wall.

13. A carton as claimed in claim 9, wherein the side walls are made from corrugated paperboard.

14. A carton as claimed in claim 9, wherein the first and second ends of said strap are initially releasably secured to said first and second margins respectively.

15. A carton as claimed in claim 11, wherein the side walls are made from corrugated paperboard which comprises an inner liner, an outer liner and a corrugated medium which extends between the inner and outer liner and wherein the reinforcing strap is sandwiched between the corrugated medium and the outer liner such that the first and second end portions of the strap can be peeled back from the side edges of their respective margin portions by tearing them through their overlying outer liner.

16. A carton as claimed in claim 9, wherein said first and second ends of said strap are secured to one another by means of a connector member to reinforce the perimeter wall.

* * * * *